US011230949B2

(12) United States Patent
Fonlupt

(10) Patent No.: US 11,230,949 B2
(45) Date of Patent: Jan. 25, 2022

(54) MACHINE FOR CONVERTING RESIDUAL HEAT INTO MECHANICAL ENERGY

(71) Applicant: ENTENT, Aix-en-Provence (FR)

(72) Inventor: Mathias Fonlupt, Carry le Rouet (FR)

(73) Assignee: ENTENT, Aix-en-Provence (FR)

( * ) Notice: Subject to any disclaimer, the term of this patent is extended or adjusted under 35 U.S.C. 154(b) by 0 days.

(21) Appl. No.: 17/250,959

(22) PCT Filed: Oct. 1, 2019

(86) PCT No.: PCT/FR2019/052315
§ 371 (c)(1),
(2) Date: Apr. 1, 2021

(87) PCT Pub. No.: WO2020/070432
PCT Pub. Date: Apr. 9, 2020

(65) Prior Publication Data

US 2021/0332723 A1 Oct. 28, 2021

(30) Foreign Application Priority Data

Oct. 2, 2018 (FR) ..... 1859135

(51) Int. Cl.
*F01K 27/00* (2006.01)
*F01K 1/08* (2006.01)
*F01K 25/08* (2006.01)

(52) U.S. Cl.
CPC ..... *F01K 27/005* (2013.01); *F01K 1/08* (2013.01); *F01K 25/08* (2013.01)

(58) Field of Classification Search
CPC ..... F01K 27/005; F01K 1/08
(Continued)

(56) References Cited

U.S. PATENT DOCUMENTS 2,102,424 A * 12/1937 Larrecq ..... F22B 3/02 60/649
2,496,041 A * 1/1950 Dickey ..... B61C 1/12 60/668

(Continued)

OTHER PUBLICATIONS

International Search Report and Written Opinion of the International Searching Authority in connection with International Application No. PCT/FR2019/052315 dated Nov. 25, 2019, 11 pages.

(Continued)

*Primary Examiner* — Mark A Laurenzi
*Assistant Examiner* — Mickey H France

(57) ABSTRACT

The invention relates to a machine for converting heat into mechanical energy comprising an expansion device producing mechanical energy from a flow of vapor of a fluid; an evaporator heated by a heat source to a high temperature and configured to supply the expansion device with vapor; a condenser cooled by a heat sink to a low temperature and configured to condense the vapor discharged by the expansion device; a liquid circuit configured to transfer fluid in liquid phase from the condenser to the evaporator; a vapor circuit configured to transfer fluid in vapor phase from the evaporator to the condenser; and valves configured to, in a first, active stroke, close the liquid and vapor circuits, and, in a second, inactive stroke, open the liquid and vapor circuits.

8 Claims, 7 Drawing Sheets

(58) Field of Classification Search
USPC ..... 60/643–684, 641.1–641.15, 614–624
See application file for complete search history.

(56) References Cited

U.S. PATENT DOCUMENTS 3,449,589 A * 6/1969 Majkrzak ..... F01D 15/10 290/2
3,503,207 A * 3/1970 Strub ..... F01K 17/06 60/667
3,508,402 A * 4/1970 Gray ..... F24V 40/00 376/402
3,704,499 A * 12/1972 Majkrzak ..... F01K 25/12 29/890.142
3,779,466 A * 12/1973 Majkrzak ..... F01K 7/16 239/489
3,798,908 A * 3/1974 Davoud ..... F01K 19/04 60/694
3,879,949 A * 4/1975 Hays ..... B01D 19/0052 60/649
3,967,449 A * 7/1976 Beck ..... F03G 7/05 60/641.7
3,972,195 A * 8/1976 Hays ..... F01D 1/06 60/671
4,009,577 A * 3/1977 Allen ..... F01K 9/003 60/692
4,079,263 A * 3/1978 Inoue ..... F01K 25/08 290/52
4,122,680 A * 10/1978 Isshiki ..... F01K 5/00 60/649
4,164,849 A * 8/1979 Mangus ..... F01K 3/181 60/679
4,272,961 A * 6/1981 Sadhukhan ..... F28F 13/125 60/641.3
4,315,402 A * 2/1982 Sadhukhan ..... F01K 21/005 60/641.3
4,330,264 A * 5/1982 Konishi ..... C04B 5/00 432/77
4,370,858 A * 2/1983 Awerbuch ..... B01D 9/0059 60/641.5
4,440,148 A * 4/1984 Assaf ..... F24S 10/13 126/567
4,471,621 A * 9/1984 Amir ..... F01D 25/32 60/657
4,490,980 A * 1/1985 Kira ..... F03G 6/005 126/636
4,505,824 A * 3/1985 Akamine ..... G21C 19/307 210/695
4,686,831 A * 8/1987 Silva ..... F22D 11/06 165/104.22
4,738,111 A * 4/1988 Edwards ..... F01K 25/08 60/671
4,876,856 A * 10/1989 Iishiki ..... F01D 15/005 60/671
4,894,993 A * 1/1990 Assaf ..... F01K 3/00 60/641.8
5,435,138 A * 7/1995 Silvestri, Jr. ..... F01D 5/00 60/652
5,638,673 A * 6/1997 Yabe ..... F02C 1/00 60/649
5,640,842 A * 6/1997 Bronicki ..... F01K 17/025 122/7 B
5,685,152 A * 11/1997 Sterling ..... B60R 16/03 60/641.15
6,857,269 B2 * 2/2005 Baker ..... B64G 1/506 60/653
8,783,043 B2 * 7/2014 Bellows ..... F01K 21/047 60/775
9,540,959 B2 * 1/2017 Freund ..... F01K 21/00
9,803,626 B1 * 10/2017 Eastman ..... F24T 10/20
10,060,302 B2 * 8/2018 Weng ..... F01K 13/006
2003/0005696 A1 * 1/2003 Wilson ..... F01N 5/02 60/618
2003/0046933 A1 * 3/2003 Moss ..... F02C 7/12 60/657
2004/0221579 A1 * 11/2004 Baker ..... B64G 1/506 60/670
2007/0163261 A1 7/2007 Strathman
2007/0199323 A1 * 8/2007 Yamaguchi ..... F01K 9/02 60/670
2010/0071368 A1 * 3/2010 Kaplan ..... F01K 25/08 60/651
2010/0132360 A1 * 6/2010 Gericke ..... F25J 3/04969 60/653
2010/0326069 A1 * 12/2010 Fong ..... H02P 9/04 60/415
2011/0079012 A1 * 4/2011 Baik ..... F01K 13/02 60/645
2011/0167825 A1 7/2011 Mauran et al.
2014/0103661 A1 * 4/2014 Kacludis ..... F01K 9/02 290/54
2014/0117670 A1 * 5/2014 Freund ..... F01K 13/02 290/52
2016/0003108 A1 * 1/2016 Held ..... F01K 23/12 60/517
2016/0040560 A1 * 2/2016 Hariri ..... F03B 13/00 60/671
2018/0045077 A1 2/2018 Brohall et al.
2019/0010834 A1 * 1/2019 Ford ..... F01K 7/32
2021/0164646 A1 * 6/2021 Batushansky ..... F01K 11/02
2021/0180471 A1 * 6/2021 Wright ..... F01K 7/16
2021/0189913 A1 * 6/2021 Bi ..... F01K 25/10

OTHER PUBLICATIONS

International Preliminary Report on Patentability dated Mar. 23, 2021 with translation of Written Opinion of the International Searching Authority in connection with International Application No. PCT/FR2019/052315, 8 pages.

* cited by examiner

MACHINE FOR CONVERTING RESIDUAL HEAT INTO MECHANICAL ENERGY

CROSS-REFERENCE TO RELATED APPLICATIONS

This application is a 371 National Stage of International Application No. PCT/FR2019/052315, filed Oct. 1, 2019, which claims priority to French Patent Application No. 1859135, filed Oct. 2, 2018, the disclosures of which are herein incorporated by reference in their entirety.

TECHNICAL FIELD

The invention relates to cycles for converting heat into mechanical energy, in particular machines using the Organic Rankine Cycle, or ORC.

BACKGROUND

An ORC cycle typically uses a working fluid with a lower boiling point than water at ambient pressure. The fluid is often an organic refrigerant, such as a hydrocarbon gas (ethane, propane, butane, propylene, etc.). A machine using an ORC cycle generally comprises four components:

An evaporator or generator heated by a heat source, which vaporizes liquid fluid at high pressure.

An expansion device, often a turbine, powered by the high-pressure steam produced by the evaporator. This expansion device produces mechanical energy that can be converted into electricity.

A condenser cooled by a heat sink, which collects the steam discharged at low pressure by the turbine and liquefies it.

A pump to feed the evaporator at high pressure from the condenser's low pressure liquid fluid.

Regardless of the refrigerant used, the temperature of the heat source at the evaporator is in practice rarely below 100° C., since the machine would then not be economically viable. This excludes many waste heat recovery applications, usually having temperatures well below 100° C.

U.S. Pat. No. 5,685,152 discloses a machine based on an ORC cycle that does not use a pump, which would allow a better exploitation of waste heat sources. The pump is replaced by a transfer tank connected between the condenser and the evaporator through respective valves. The tank operates in four steps. In the first step, the tank is opened to the condenser to receive liquid fluid at low pressure by gravity. In a second step, the tank is closed and heated by the heat source. The fluid in the tank vaporizes, at least partially, and its pressure increases. In a third step, when the pressure in the tank is close to that of the evaporator, the tank is opened to the evaporator. The pressures in the tank and the evaporator equalize, while the liquid remaining in the tank is transferred to the evaporator by gravity. In a fourth step, the tank is closed and cooled by the heat sink. The vapor in the enclosure liquefies and the pressure drops.

In principle, such a machine can supply steam to a turbine relatively continuously, but it is difficult to alternately heat and cool the transfer tank fast enough to obtain a usable flow rate.

SUMMARY

A machine for converting heat into mechanical energy is generally provided, comprising an expansion device producing mechanical energy from a flow of vapor of a fluid; an evaporator heated by a heat source to a high temperature and configured to supply vapor to the expansion device; a condenser cooled by a heat sink to a low temperature and configured to condense the vapor discharged from the expansion device; a liquid circuit connecting a liquid phase of the condenser to a liquid phase of the evaporator; a vapor circuit connecting a vapor phase of the evaporator to a vapor phase of the condenser; and valves configured to, during a first, active stroke, close the liquid and vapor circuits, and, during a second, inactive stroke, open the liquid and vapor circuits.

The machine may further comprise a buffer vapor tank cooled by the heat sink to the low temperature with a corresponding saturating steam pressure; and a valve configured to connect the buffer tank to the condenser during the active stroke and close the buffer tank during the inactive stroke.

The liquid and vapor circuits may be configured to perform transfers passively, respectively by pressure equalization in the vapor circuit and by gravity in the liquid circuit.

The liquid circuit may be configured to perform transfers by level equalization.

The machine may further comprise a first transfer stage inserted in the liquid and vapor circuits, and heated from the heat source to a first intermediate temperature between the high and low temperatures; low-pressure-side valves on the liquid and vapor circuits between the first transfer stage and the condenser, configured to close during the active stroke and open during the inactive stroke; and high-pressure-side valves on the liquid and vapor circuits between the first transfer stage and the evaporator, configured to open during the active stroke and close during the inactive stroke.

The machine may further comprise a second transfer stage inserted in the liquid and vapor circuits between the evaporator and the high-pressure-side valves of the first transfer stage, and heated from the heat source to a second intermediate temperature between the high temperature and the first intermediate temperature; and high-pressure-side valves on the liquid and vapor circuits between the second transfer stage and the evaporator, configured to close during the active stroke and open during the inactive stroke.

The expansion device may be a positive displacement device, comprising a cylinder; a piston sliding in the cylinder and defining two variable volumes in the cylinder, a first of the two variable volumes being connected to the evaporator; a discharge valve configured to connect the second of the two variable volumes to the condenser during the active stroke; and a check valve configured to connect the second variable volume to the evaporator during the inactive stroke.

The machine may comprise a valve between the expansion device and the condenser, configured to open during the active stroke and close during the inactive stroke.

BRIEF DESCRIPTION OF THE DRAWINGS

Embodiments will be exposed in the following description provided for exemplary purposes only, in relation to the attached figures, in which.

DETAILED DESCRIPTION

In the following disclosure, a machine is provided for the conversion of waste heat into mechanical energy inspired by an ORC cycle, but operating without a pump and in a reciprocating manner. More specifically, the machine operates according to a two-stroke cycle determined by valves:

In a first, active or drive stroke, fluid communication between the condenser and the evaporator is cut off while the expansion device is mobilized by the evaporator.

In a second, inactive or regeneration stroke, pressure and liquid level equalization takes place between the condenser and the evaporator in a passive manner by means of separate liquid and vapor circuits.

As a result of the implementation of the second stroke, both the evaporator and the condenser operate continuously with a two-phase fluid at saturating vapor pressure.

Figure 1B:
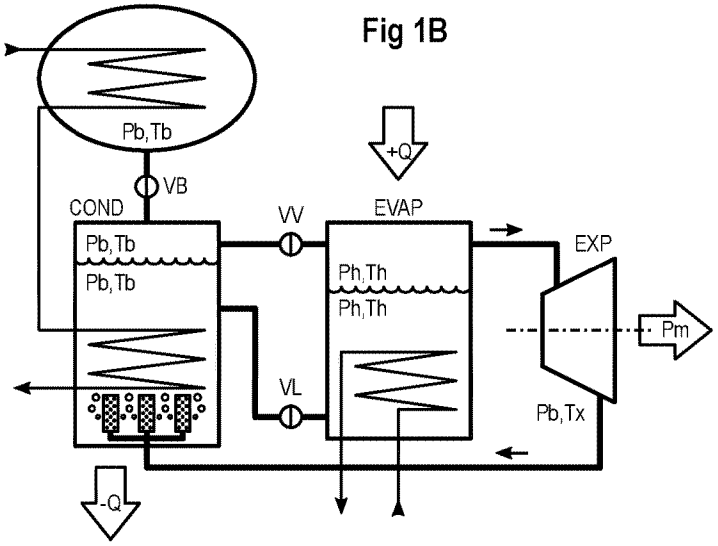
FIGS. 1A, 1B, 2A and 2B schematically represent a first embodiment of a heat to mechanical energy conversion machine without a pump, at different stages of operation.
Figure 1A:
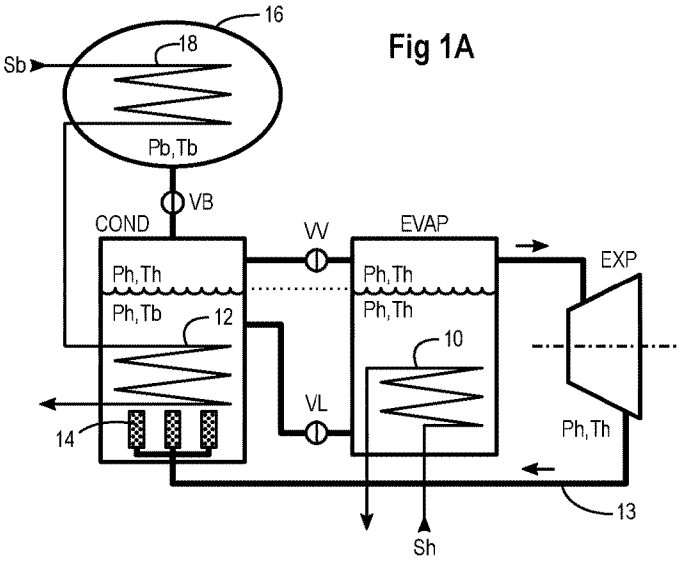

FIGS. 1A and 1B schematically represent a first embodiment of a machine operating according to this principle, at the beginning and during the first, drive stroke.

The machine includes an evaporator EVAP in the form of a tank containing working fluid present in both vapor and liquid phases. The liquid phase is heated to a high temperature Th by a heat source Sh using an exchanger, shown in the form of a coil 10 immersed in the liquid phase. A tube connects the upper part of the evaporator (the vapor phase) to the inlet of an expansion device EXP.

The high temperature Th corresponds with a high saturation pressure Ph, contingent to the fluid used. Thus, the liquid and vapor phases in the evaporator are both, under steady state conditions, at the saturation conditions (Ph, Th).

A condenser COND is also provided in the form of a tank containing fluid present in vapor and liquid phases. The liquid phase of the condenser is cooled to a low temperature Tb by a heat sink Sb with the help of an exchanger, shown in the form of a coil 12 immersed in the liquid phase.

The low temperature Tb corresponds with a low saturation pressure Pb, contingent to the fluid used. Thus, the liquid and vapor phases in the condenser are both, under steady state conditions, at the saturation conditions (Pb, Tb).

A liquid circuit, including a line with a valve VL, connects the liquid phases of the evaporator and the condenser. In addition, a vapor circuit, including a line with a valve VV, connects the vapor phases of the evaporator and the condenser.

The expansion device EXP discharges into the lower part of the condenser through a line 13. The expanded and partially cooled vapor from the expansion device thus enters the cold liquid phase of the condenser, where the vapor condensation continues and can be promoted by bubblers 14.

To improve the efficiency of the system, as will be seen below, a cold vapor buffer tank 16 may be provided, connected to the top of the condenser by a line fitted with a valve VB. The buffer tank 16 is cooled by the heat sink Sb using an exchanger, shown as coil 18 in series with coil 12. The vapor in buffer tank 16 is maintained substantially constantly at the saturation conditions (Pb, Tb) of the condenser.

In FIG. 1A, at the beginning of the drive stroke, all the valves have just been switched, i.e. the valve VB has just been opened, and the valves VV and VL have just been closed. The liquid phase of the condenser is at the low temperature Tb, while the vapor phase of the condenser is transiently at the high temperature Th and the high pressure Ph, conditions that were reached at the end of the previous stroke. The liquid phase of the condenser is thus also transiently at the pressure Ph.

The liquid and vapor phases in the evaporator are at the saturating conditions (Ph, Th), conditions that remain fairly constant throughout the cycle.

The liquid levels in the condenser and evaporator have been equalized at the previous stroke.

As soon as the valve VB is opened, the buffer tank 16 quickly imposes its conditions (Pb, Tb) to the vapor phase of the condenser. An optimum buffer tank volume depends on a number of parameters, including the type of working fluid and the operating conditions of the condenser and evaporator. It can be noted that the simple addition of a buffer tank of non-zero volume significantly increases the efficiency of the machine compared to an alternative without a buffer tank, whereby the buffer tank does not need to be particularly large to achieve a machine with better performance than a conventional ORC cycle. In addition, the condenser may be designed so that its vapor volume tends to zero at this stage. It is even possible to accept that the liquid level rises into the buffer tank 16 at the end of the drive stroke.

FIG. 1B shows the machine at a steady state reached during the drive stroke. Thanks to the buffer tank 16, the pressure in the condenser quickly tends towards the low pressure Pb and creates a vacuum in the discharge line of the expansion device EXP. The negative pressure in the discharge line is compensated by the production of vapor in the evaporator at almost constant conditions (Ph, Th), which mobilizes the expansion device by producing mechanical energy Pm.

In the discharge area of the expansion device, the pressure tends towards the pressure Pb of the condenser, while the temperature tends towards a value Tx between Th and Tb, depending on the flow rate and the fluid, which may initiate condensation of the vapor in the discharge line 13.

The production of vapor lowers the liquid level in the evaporator, and the condensation of this vapor raises the liquid level in the condenser, as shown.

In addition, the vapor production in the evaporator absorbs heat +Q at the heat source Sh through exchanger 10, while the condensation of the vapor in the condenser yields heat −Q at the heat sink Sb through exchanger 12.

Figure 2B:
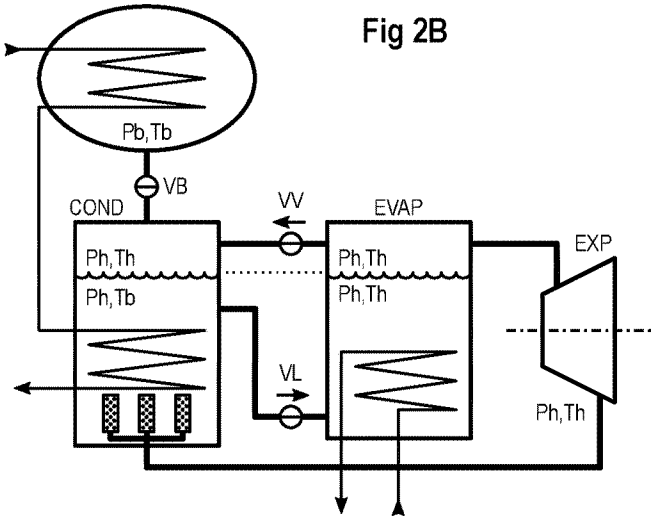
Figure 2A:
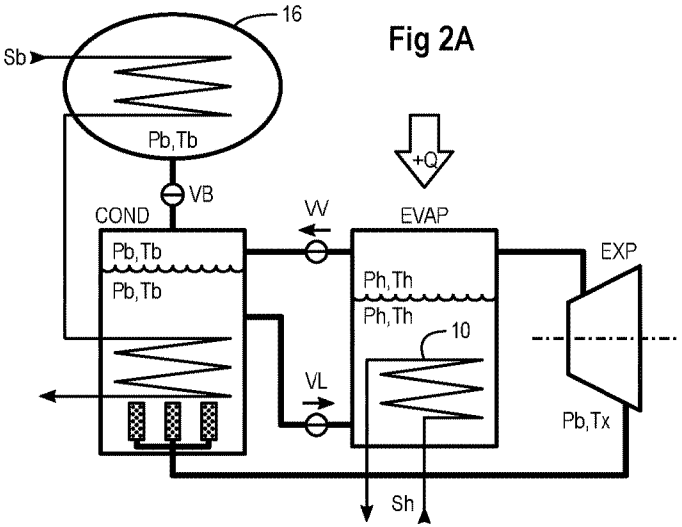

FIGS. 2A and 2B schematically represent the machine of FIGS. 1A and 1B at the beginning and during the second, regeneration stroke.

In FIG. 2A, at the start of the regeneration stroke, all the valves have just been switched from the states of FIG. 1B, i.e. the valve VB has just been closed and the valves VV and VL have just been opened. The fluids in the condenser and evaporator are at saturating conditions (Pb, Tb) and (Ph, Th) respectively.

The valves VV and VL open the vapor and liquid circuits between the evaporator and the condenser, which tends to equalize pressures and liquid levels. Thus, the excess liquid in the condenser flows to the evaporator through the liquid circuit. Since this liquid is cold (Tb), it is heated by the liquid in the evaporator and by the exchanger 10, taking heat +Q from the heat source Sh. To promote exchanges, the liquid line is connected to the condenser as close as possible to the liquid level and to the base of the evaporator, as shown.

The vapor circuit connects two vapor phases at different saturation conditions. The vapor part of the evaporator (at pressure Ph) would expand into the vapor part at lower pressure (Pb) of the condenser. According to the Mollier diagram of the fluid under saturating conditions, it is not an expansion per se that takes place (a pressure drop) but an increase in the proportion of vapor at constant pressure Ph, which occurs by increasing the enthalpy of the fluid, i.e. by taking heat +Q from the heat source Sh.

As for the vapor part of the condenser, which is in a small proportion due to the fact that communication with the buffer tank 16 is cut off by the valve VB, it is compressed by the higher pressure of the evaporator, which causes it to condense, at least partially. This condensation and contact with the hot vapor from the evaporator heats the liquid at the surface. The hotter liquid at the surface does not come into contact with the exchanger 12 and is transferred to the evaporator by the liquid circuit.

(Note that the letters Q used to designate a heat are purely indicative and do not represent values. The actual theoretical values can be found from the Mollier diagram of the fluid.)

FIG. 2B shows the state of the system during the regeneration stroke. The liquid levels and pressures (Ph) in the evaporator and condenser have equalized. The temperature of the vapor phase in the condenser is Th, while the temperature of the liquid phase is maintained at Tb by the heat sink Sb. The vapor and liquid parts in the condenser are transiently no longer under saturating conditions. In fact, the vapor parts in communication between the condenser and the evaporator are at the saturating conditions of the evaporator that imposes these conditions thanks to the heat supplied by the heat source Sh.

The expansion device EXP is no longer subject to a pressure difference and continues its movement by inertia.

A new drive stroke then starts according to FIGS. 1A and 1B.

It can be noted that the valve VL in the liquid circuit may be a simple check valve, allowing the passage of liquid in the direction from the condenser to the evaporator. In this case, the valve opens only when the pressures are equalized between the condenser and the evaporator, thus preventing a transient discharge of liquid from the evaporator to the condenser at the beginning of the regeneration stroke, when the pressures are not yet equalized. This advantage may be offset by the fact that a check valve introduces higher pressure drops than a controlled valve. To combine the advantages of these two alternatives, the valve VL may be a controlled valve associated with pressure sensors, such that it only opens when the pressures in the condenser and evaporator are detected as equal.

If the expansion device EXP is designed to accept a continuous flow of vapor, as in the case of a turbine or rotary positive displacement motor, the two strokes of the cycle may have different durations. In particular, the drive stroke may be longer than the regeneration stroke, the latter being reduced to the time required to complete the equalization of pressures and liquid levels through the liquid and vapor circuits.

One role of the cold vapor buffer tank 16 is to allow the condenser to quickly return to its nominal saturation conditions (Pb, Tb) during the drive stroke, so that a difference in drive pressure between the inlet and outlet of the expansion device EXP can be established as quickly as possible. The efficiency of the machine decreases with this latency.

However, the machine may also be operated without the buffer tank 16, but the expansion device is then mobilized with a certain delay due to the time required to build up a sufficiently low pressure in the condenser. Exchanger 12 could then be designed to also cool the vapor part of the condenser, but the efficiency of the machine would still be reduced.

Because the machine has a "pulsed" operation, i.e. the expansion device is powered in an alternating manner, it may be unsuitable for the use of a conventional turbine as an expansion valve. This is because turbines are generally designed to operate with a continuous flow of vapor. Thus, it may be preferable to use a positive displacement motor as an expansion device, such as a piston motor.

Figure 3A:
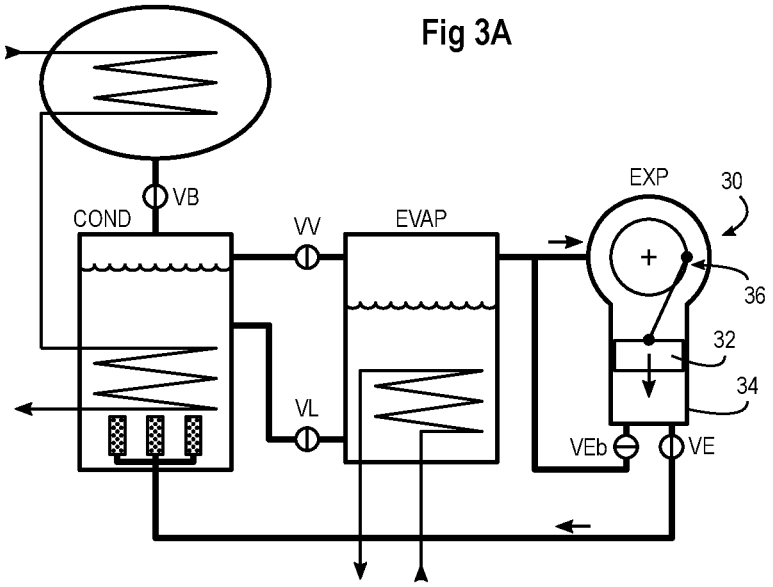
FIGS. 3A and 3B show an example of the use of a piston expander in the machine of the previous figures, in two operating stages.
Figure 3B:
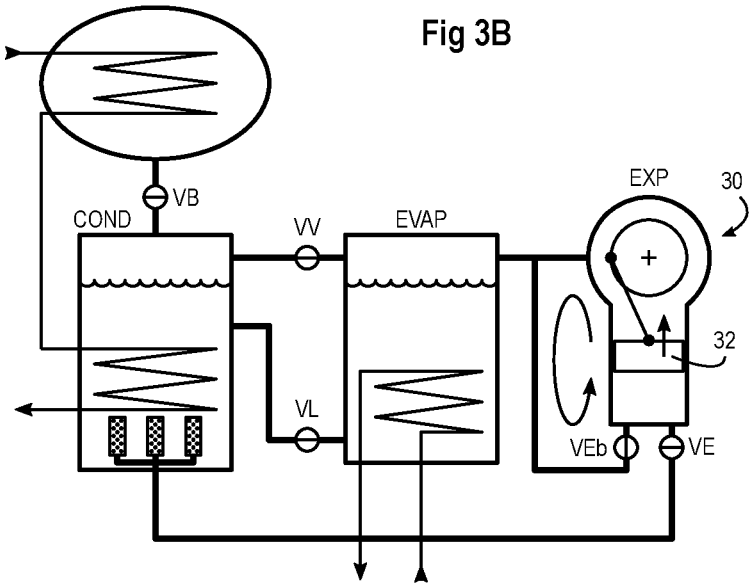

FIGS. 3A and 3B show an exemplary implementation of a piston motor 30 as an expansion device, respectively during the drive stroke and the regeneration stroke. Motor 30 has a piston 32 configured to reciprocate in a cylinder 34. Cylinder 34 is fitted with two valves at the head of the piston, i.e. a valve VE on the line to the condenser COND and a valve VEb on a line back to the evaporator outlet. The outlet of the evaporator is connected to a closed chamber at the back of the piston. The reciprocating motion of the piston may be converted into rotation by a rod and crankshaft system 36 located at the rear of the piston.

In FIG. 3A, during the drive stroke, the valve VE is open and the valve VEb is closed. The rear of piston 32 is pushed by the vapor generated by the evaporator, while the vapor in cylinder 34 is discharged through the valve VE to the condenser.

In FIG. 3B, during the regeneration stroke, the valve VE is closed and the valve VEb is open. The line to the condenser is thus closed, but the opening of the valve VEb connects the volumes on both sides of the piston, so that the piston returns freely, by inertia, to its starting point for the next cycle.

In principle, at the beginning of the drive stroke (at the end of the regeneration stroke), the piston is at its low dead point, i.e. the position where the volume in cylinder 34 is maximum. At the end of the drive stroke (at the start of the regeneration stroke), the piston reaches its high dead point, where the volume in cylinder 34 is minimal. The valves are therefore preferably synchronized with the movement of the piston in order to switch at each piston dead point.

In addition, since the piston returns by inertia to the low dead point during the regeneration stroke, both strokes of the cycle are constrained to have the same duration.

In the machines described up to now, during the transition from drive stroke to regeneration stroke, a high-pressure chamber (the evaporator) and a low-pressure chamber (the condenser) are abruptly connected through the valves VV and VL. If the pressure difference Ph−Pb is significant, this may lead to harmful shocks. As an example, using propylene (R1270) as the working fluid, temperatures Tb=30° C. and Th=80° C. yield saturating pressures Pb=13 bar and Ph=37 bar, i.e. a pressure differential of 24 bar.

Figure 4A:
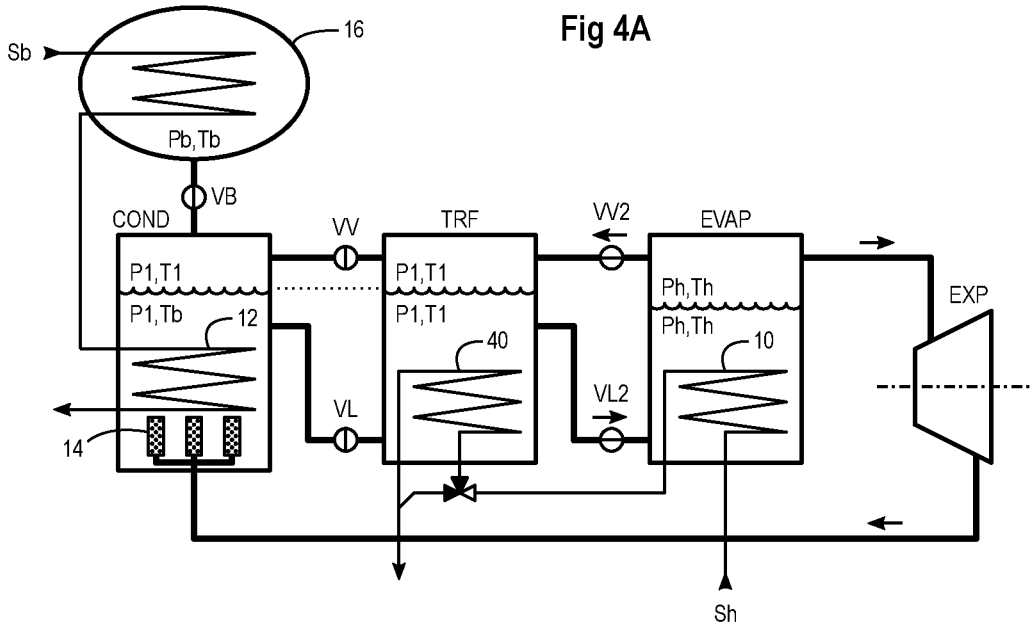
FIGS. 4A, 4B, 5A and 5B schematically represent a second embodiment of a heat-to-mechanical energy conversion machine without a pump, at different stages of operation.
Figure 4B:
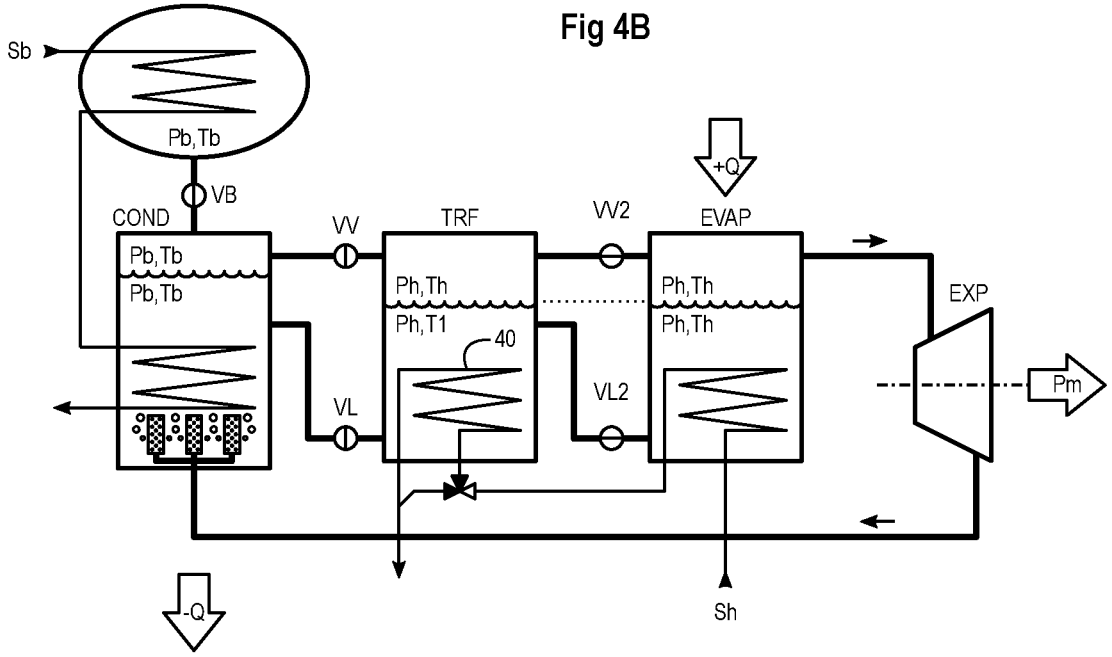

FIGS. 4A and 4B schematically represent a second embodiment of a heat conversion machine, designed to limit pressure shocks, respectively at the beginning and during the drive stroke. Compared to the machine of the previous figures, a transfer stage TRF is inserted in the liquid and vapor circuits between the evaporator EVAP and the condenser COND. The transfer stage is in the form of a tank containing working fluid present in both vapor and liquid phases. The liquid phase is heated by a bypass of the heat source Sh using an exchanger, shown as a coil 40 immersed in the liquid phase. The bypass, illustrated by a three-way valve, is designed to bring the fluid to a temperature T1 comprised between the temperatures Tb and Th. The corresponding saturation pressure is P1.

The vapor phase of the transfer stage is connected to the vapor phases of the condenser and the evaporator by respective lines fitted with valves VV and VV2. The liquid phase of the transfer stage is connected to the liquid phases of the condenser and the evaporator by respective lines fitted with valves VL and VL2. The valves VV2 and VL2 are controlled in phase opposition to the valves VV and VL.

In FIG. 4A, the valves VV and VL have just been closed, and the valve VB opened, as for the machine in FIG. 1A. In addition, valves VV2 and VL2 have just been opened. The liquid levels in the condenser and the transfer stage have been equalized.

The vapor phase of the condenser is transiently at conditions (P1, T1) instead of at conditions (Ph, Th) of FIG. 1A. These conditions are quickly returned to (Pb, Tb) by buffer tank 16, faster than in FIG. 1A, since the values P1, T1 are closer to Pb, Tb. As the transient pressure P1 is already lower than Ph, the expansion device EXP is immediately mobilized.

The vapor phase of the transfer stage TRF is initially at conditions (P1, T1). The valves VV2 and VL2 between the transfer stage and the evaporator are open, so the pressures and liquid levels will equalize therein. Equalizing takes place similarly to between the evaporator and the condenser in FIGS. 2A and 2B, i.e. the evaporator imposes its conditions (Ph, Th) to the vapor part of the transfer stage.

FIG. 4B shows the machine during the drive stroke. The liquid and vapor phases of the condenser are at their saturated conditions (Pb, Tb), optimal for mobilizing the expansion device. The liquid levels and pressures (Ph) in the transfer stage and the evaporator are equalized. The temperature of the vapor phase in the transfer stage is Th, while that of the liquid phase is maintained at T1 by exchanger 40. The vapor and liquid parts in the transfer stage are no longer, transiently, under saturated conditions until the next cycle.

The vapor discharged from the expansion device liquefies in the condenser and increases the liquid level in the condenser. This condensation yields heat −Q to the heat sink Sb.

The evaporator produces vapor to both feed the expansion device and compress the vapor phase of the transfer stage. This vapor production lowers the liquid level in the evaporator and the transfer stage and absorbs heat +Q from the heat source Sh. Part of this heat +Q is also used to heat the liquid at temperature T1 coming from the transfer stage. The vapor that was at conditions (P1, T1) in the transfer stage condenses at least partially.

Figure 5A:
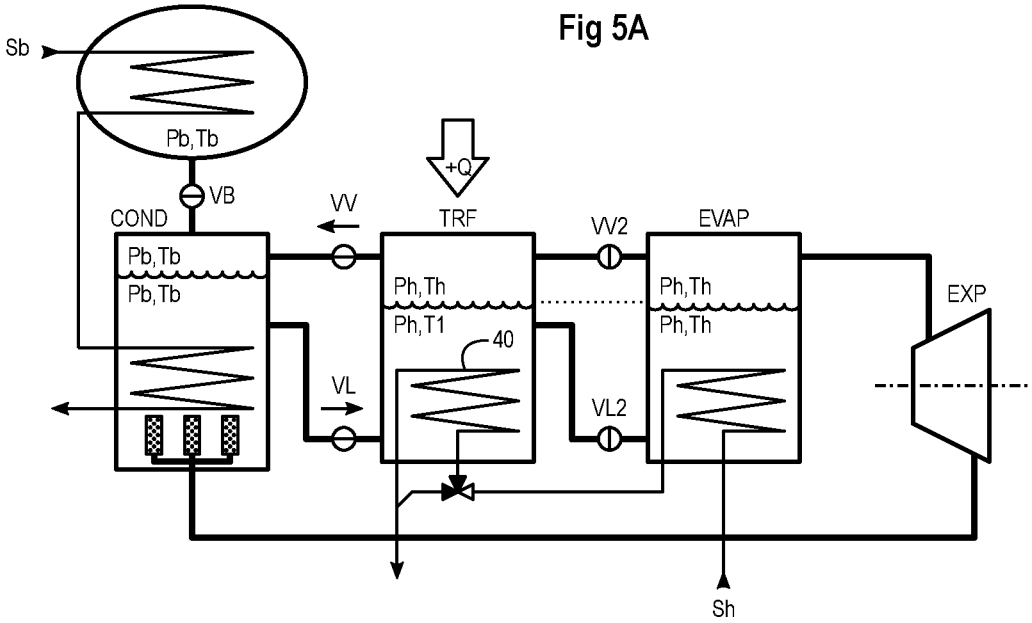
Figure 5B:
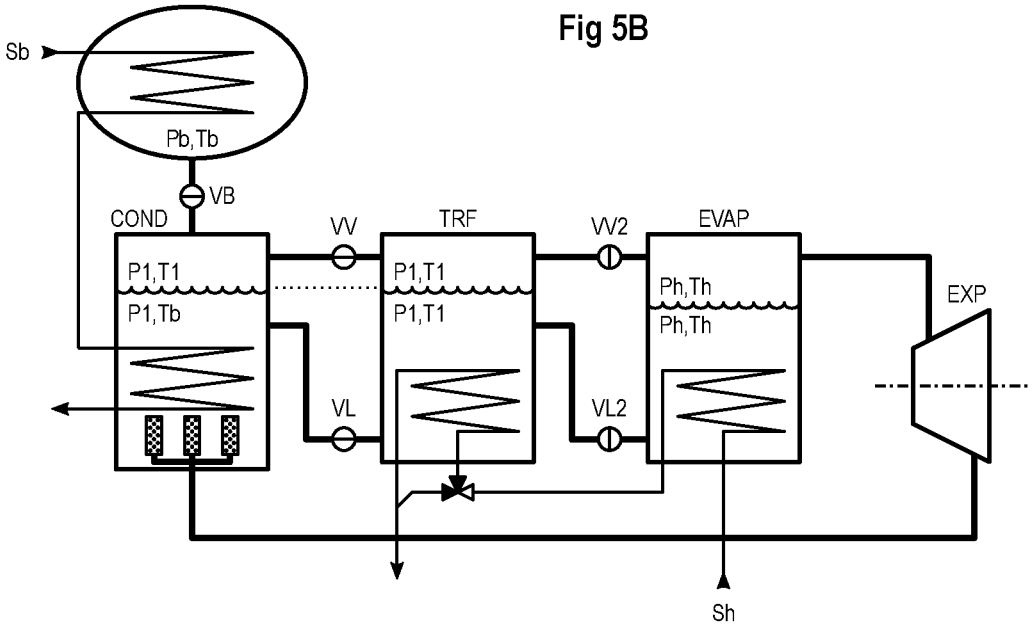

FIGS. 5A and 5B schematically show the machine of FIGS. 4A and 4B at the start and during the regeneration stroke.

In FIG. 5A, at the start of the regeneration stroke, all the valves have just been switched from the state of FIG. 4B, i.e. valves VB, VV2 and VL2 have just been closed and valves VV and VL have just been opened.

The valves VV and VL open the vapor and liquid circuits between the transfer stage and the condenser, which tends to cause equalization of pressures and liquid levels, as between the condenser and the evaporator in FIG. 2A.

The vapor part of the transfer stage TRF is transiently at the conditions (Ph, Th) that are no longer maintained by the evaporator when the valves VV2 and VL2 are closed. The vapor, which is at a pressure higher than the saturating pressure (P1) of the liquid, tends towards an equilibrium through an expansion and a lowering of the temperature towards the saturating conditions (P1, T1).

The transfer stage TRF imposes its conditions (P1, T1) to the vapor part of the condenser by producing vapor. The vapor production absorbs heat +Q through the exchanger 40. The vapor that was at the conditions (Pb, Tb) in the condenser condenses at least partially.

Even if the pressure in the transfer stage is transiently at the high pressure Ph, this pressure is not maintained and drops almost instantaneously to the nominal pressure P1 of the transfer stage, so that the system in practice experiences a pressure differential P1−Pb instead of Ph−Pb at the opening of the valves VV and VL.

The conditions (P1, T1) may be chosen so that P1=(Pb+Ph)/2, which balances the pressure differences, on the one hand between the evaporator and the transfer stage during the drive stroke, and on the other hand between the transfer stage and the condenser during the regeneration stroke, and limits the shocks due to these pressure differences. In the example of propylene where (Pb, Tb)=(13 bars, 30° C.) and (Ph, Th)=(37 bars, 80° C.), one could choose (P1, T1)=(25 bars, 60° C.).

FIG. 5B shows the state of the system during the regeneration stroke. The liquid levels and pressures (P1) in the transfer stage and the condenser have equalized. The temperature of the vapor phase in the condenser is T1, while the temperature of the liquid phase is maintained at Tb by the heat sink Sb. The vapor and liquid parts in the condenser are transiently no longer under saturated conditions until the next cycle.

In the embodiment of FIGS. 4A to 5B, the expansion device is of a continuous flow type (turbine or rotary positive displacement motor). During the drive stroke, the expansion device is still subject to the pressure difference Ph−Pb, as described above. However, during the regeneration stroke, the expansion device is subject to the lower pressure difference Ph−P1 that still transfers a certain amount of energy to the expansion device. Since the liquid phase in the condenser is kept at the low temperature Tb, the condensation of the vapor from the expansion device is still achieved under good conditions.

When using a piston expansion valve, as in FIGS. 3A and 3B, or if it is desired to adjust the operating conditions of the machine, the discharge line may be fitted with a valve VE, which is closed during the regeneration stroke. In this case the evaporator remains inactive during the regeneration stroke.

To homogenize the flow received by the expansion device, two machines of the previous type, operating in phase opposition, may be used.

Figure 6:
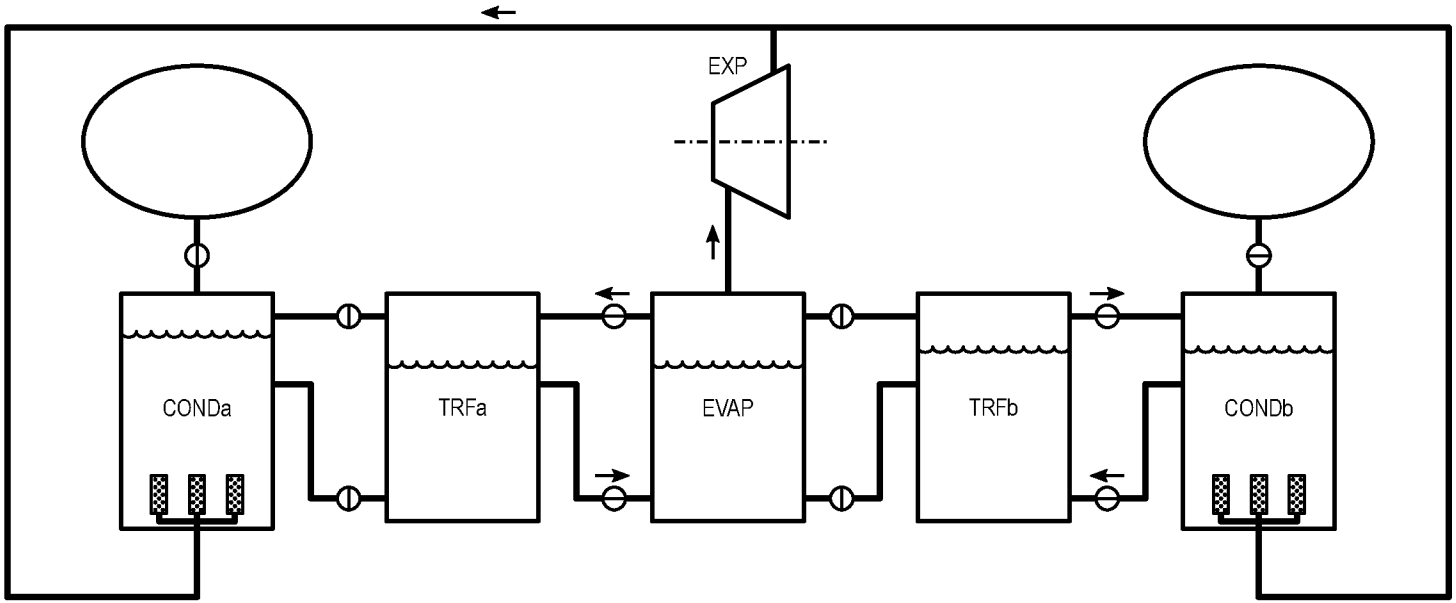
FIG. 6 schematically represents a third embodiment of a heat-to-mechanical energy conversion machine without a pump.

In FIG. 6, instead of using two complete machines, two partial machines are used that share the same evaporator, allowing the evaporator to operate more continuously and under better conditions. Thus, the machine includes a single evaporator EVAP feeding the expansion device EXP. The expansion device discharges into two channels operating in phase opposition, associated respectively with two condensers CONDa and CONDb and two corresponding transfer stages TRFa and TRFb. The two transfer stages TRFa, TRFb are connected to the common evaporator EVAP.

The valves associated with the two channels are controlled in phase opposition. Thus, the single evaporator alternately feeds the transfer stage of one of the channels (e.g. TRFa, as shown) and then the transfer stage of the other channel, while it feeds the expansion device relatively continuously.

The two strokes of each cycle may have distinct durations, for example a drive stroke longer than the regeneration stroke, as mentioned above. In this case, the valves are not strictly controlled in phase opposition, but in such a way that the regeneration stroke of each channel takes place within the drive stroke of the other channel. The regeneration stroke of one channel may, for instance, be centered on the drive stroke of the other channel.

Figure 7A:
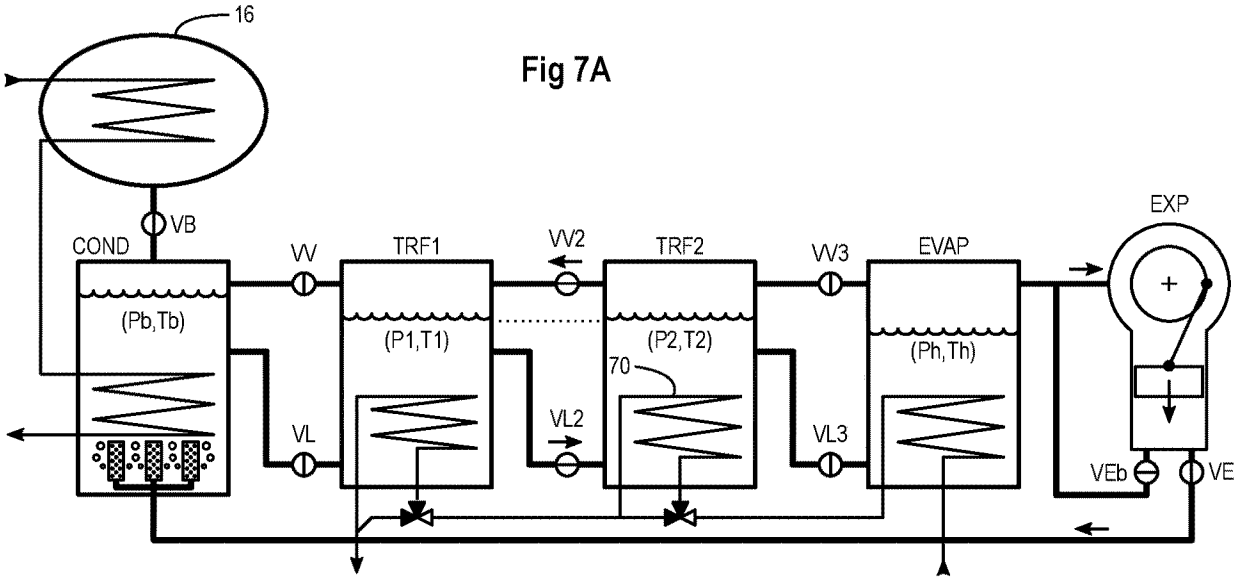
FIGS. 7A and 7B schematically represent a fourth embodiment of a heat-to-mechanical energy conversion machine without a pump, at different stages of operation.
Figure 7B:
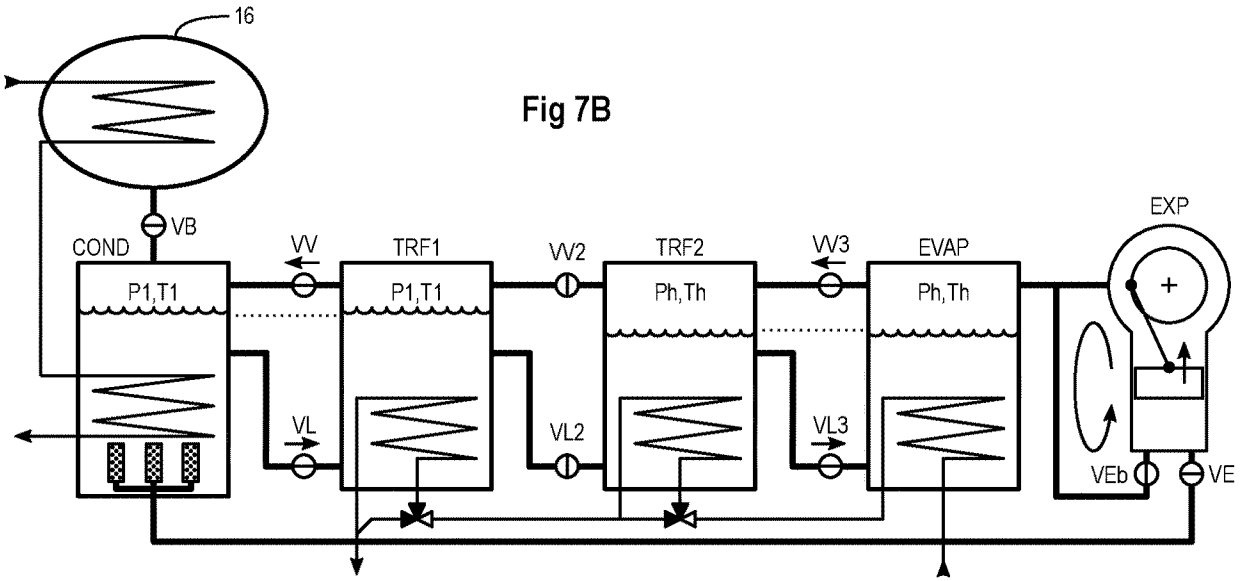

FIGS. 7A and 7B schematically illustrate, respectively during the drive stroke and the regeneration stroke of the cycle, another embodiment of a heat conversion machine with a transfer stage allowing a more continuous use of the evaporator with a piston expansion device. This embodiment aims to supply vapor to the expansion device during the drive stroke and to supply vapor to the transfer stage during the regeneration stroke.

Compared to FIGS. 4A and 5A, the machine includes a second transfer stage TRF2, associated with corresponding valves VV3, VL3, inserted in the liquid and vapor circuits between the valves VV2, VL2 on the high-pressure side of the first transfer stage TRF1 and the evaporator EVAP. The expansion device EXP is similar to the piston motor of FIGS. 3A and 3B. Since the individual functions of these components have been described in detail, they will not be described again.

The saturation conditions of the various elements are shown in FIG. 7A. The temperature T2 of the transfer stage TRF2 is comprised between T1 and Th, and is maintained by an exchanger 70 supplied by a bypass line from the heat source Sh. Valves VV3 and VL3 are controlled in phase opposition with respect to valves VV2 and VL2.

In FIG. 7A, illustrating the drive stroke, valves VB, VV2, VL2, and VE are open, while valves VV, VL, VV3, VL3, and VE2 are closed. The evaporator EVAP supplies only the expansion device EXP, while the stage TRF2 supplies the stage TRF1. The vapor parts of stages TRF1 and TRF2 are set at the conditions (P2, T2), and the liquid levels are equalized.

In FIG. 7B, showing the regeneration stroke, the valves are reversed, i.e. valves VB, VV2, VL2, and VE are closed, while valves VV, VL, VV3, VL3, and VE2 are open. The evaporator EVAP only feeds the stage TRF2, while the stage TRF1 feeds the condenser. The vapor parts of stage TRF2 and the evaporator are set at the conditions (Ph, Th), and the liquid levels are equalized. Similarly, the vapor parts of stage TRF1 and the condenser are set at conditions (P1, T1), and the liquid levels are equalized.

With this structure, over a cycle, the evaporator alternately feeds the expansion device and the transfer stage TRF2, ensuring a certain continuity of operation. In addition, this structure further reduces the risk of pressure shocks, since the pressure P1 can be selected even lower than in a machine with a single transfer stage. The pressures of the transfer stages may be chosen, for example, such that P1=Pb+(Ph−Pb)/3 and P2=Pb+2(Ph−Pb)/3.

In general, it is possible to multiply the transfer stages thus connected in series in the vapor and liquid circuits, by heating them to temperatures between Tb and Th, each stage being associated with two valves on the high-pressure side operating in phase opposition with respect to the valves of the adjacent stage.

Since the various disclosed embodiments of the heat conversion machine involve liquid transfers by gravity, the relative heights of the elements are parameters to be considered. For sake of clarity of presentation, the elements have been represented at the same height, assuming that the liquids equalize at the same level.

In practice, under saturation conditions, the liquids have different densities depending on temperature. Thus, liquid propylene saturated at 30° C. has a density of about 490 kg/m3, while at 80° C. it has a density of about 375 kg/m3. This means that the liquid levels equalize at different heights, with the level of the liquid of lower density equalizing higher. Thus, the elements are in practice not arranged at the same height, but are staggered, so that the hottest element is lower. The levels are established approximately according to the relationship h1r1=h2r2, where h1 and h2 are the heights of the liquids relative to their point of communication, and r1 and r2 are the densities of the liquids. Thus, the level of the warmer liquid also depends on the inlet line height of the colder liquid.

Figure 8:
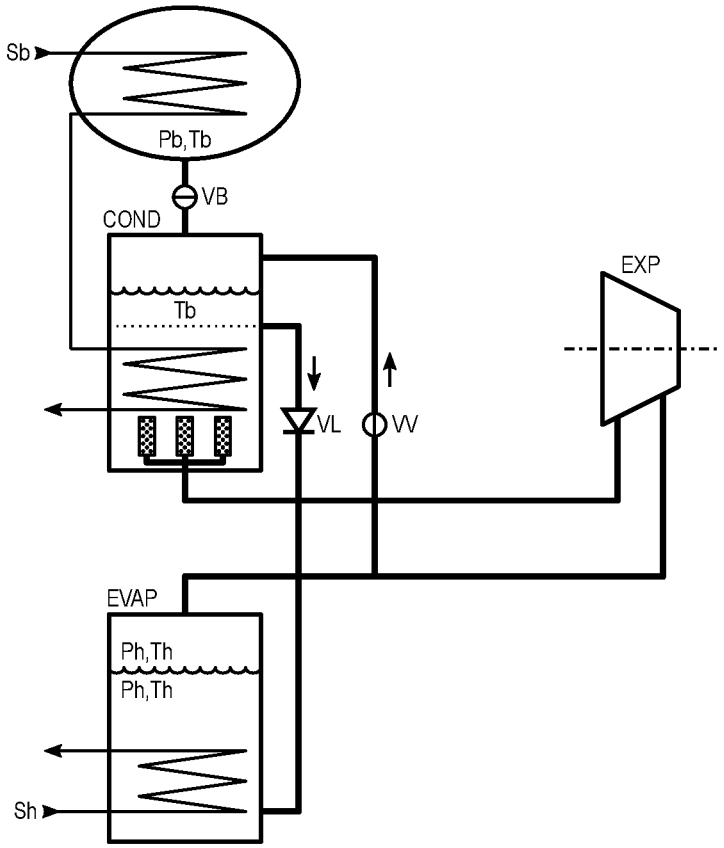
FIG. 8 schematically represents a fifth embodiment of a heat-to-mechanical energy conversion machine without a pump.

FIG. 8 illustrates a machine embodiment operating by simple gravity instead of by equalizing liquid levels. The machine shown as an example is based on the machine of FIGS. 1 and 2, without a transfer stage. The condenser COND, instead of being arranged beside the evaporator EVAP, is arranged above the evaporator. The other structural elements are maintained—in particular, the liquid line is connected to the upper part of the condenser and the lower part of the evaporator. The liquid line valve has been illustrated as a check valve.

During the regeneration stroke shown, the valve VV in the vapor circuit is opened, causing pressure equalization in the condenser and the evaporator. The liquid level in the condenser has reached its maximum level as a result of the condensation of the vapor produced during the drive stroke. At pressure equilibrium, the valve VL opens and allows the liquid to flow by gravity from the condenser to the evaporator. The liquid transfer ends when the level in the condenser reaches the height of the liquid line connection. The maximum amount of liquid transferred during the regeneration stroke can thus be adjusted by selecting the height of the liquid line connection.

For machines with transfer stages, the structure of FIG. 8 can be reproduced between the condenser and a transfer stage, between a transfer stage and the evaporator, and, if necessary, between two transfer stages. The "vertical" structure of FIG. 8 may even be combined here with the "horizontal" structure of the other embodiments, e.g. by arranging the condenser above the transfer stage and the evaporator beside the transfer stage.

In the description of the various embodiments the dimensions of the components have not been considered. In practice, each component may be designed so that it always contains the two phases of the fluid under saturation conditions at any point in the cycle. Thus, in particular, the evaporator is designed so that the liquid is never completely vaporized at the end of the drive stroke, and the condenser is designed so that the vapor is never completely condensed at the end of the drive stroke. These factors also depend on the component temperatures and the desired flow rates. For a high flow rate, the evaporator will produce more vapor, so more liquid will be vaporized, and thus larger dimensions will be required. The main role of the transfer stages is to transfer liquid from the condenser to the evaporator and they produce less vapor than the evaporator, so they use less fluid and may be smaller than the evaporator.

In the absence of a heat source, the machine cools down to ambient temperature, and the fluid contained in the various components remains at saturation conditions, assuming the machine is sealed. Thus, with propylene and an ambient temperature of 20° C., the general conditions in the machine establish at (10 bar, 20° C.).

To start the machine, it is sufficient to switch the valves to the inactive stroke position and heat the evaporator. When the evaporator reaches a pressure sufficient to start, the valves are switched to the active stroke position. When the expansion device is piston operated, the piston is placed in the start position for the drive stroke.

Although the present disclosure has been described with an exemplary embodiment, various changes and modifications may be suggested to one skilled in the art. It is intended that the present disclosure encompass such changes and modifications as fall within the scope of the appended claims. None of the description in this application should be read as implying that any particular element, step, or function is an essential element that must be included in the claims scope. The scope of patented subject matter is defined by the claims.

The invention claimed is:

1. A machine for converting heat into mechanical energy, the machine comprising:

an expansion device producing mechanical energy from a flow of vapor of a fluid;

an evaporator heated by a heat source to a high temperature and configured to supply vapor to the expansion device;

a condenser cooled by a heat sink to a low temperature and configured to condense the vapor discharged from the expansion device;

a liquid circuit connecting a liquid phase of the condenser to a liquid phase of the evaporator;

a vapor circuit connecting a vapor phase of the evaporator to a vapor phase of the condenser; and valves configured to, during a first, active stroke, close the liquid and vapor circuits, and during a second, inactive stroke, open the liquid and vapor circuits.

2. The machine according to claim 1, further comprising:

a buffer vapor tank cooled by the heat sink to the low temperature with a corresponding saturating steam pressure; and a valve configured to connect the buffer tank to the condenser during the active stroke and close the buffer tank during the inactive stroke.

3. The machine according to claim 1, wherein the liquid and vapor circuits are configured to perform transfers passively, respectively by pressure equalization in the vapor circuit and by gravity in the liquid circuit.

4. The machine according to claim 3, wherein the liquid circuit is configured to perform transfers by level equalization.

5. The machine according to claim 1, further comprising:

a first transfer stage inserted in the liquid and vapor circuits, and heated from the heat source to a first intermediate temperature between the high and low temperatures;

low-pressure-side valves on the liquid and vapor circuits between the first transfer stage and the condenser, configured to close during the active stroke and open during the inactive stroke; and high-pressure-side valves on the liquid and vapor circuits between the first transfer stage and the evaporator, configured to open during the active stroke and close during the inactive stroke.

6. The machine according to claim 5, further comprising:

a second transfer stage inserted in the liquid and vapor circuits between the evaporator and the high-pressure-side valves of the first transfer stage, and heated from the heat source to a second intermediate temperature between the high temperature and the first intermediate temperature; and high-pressure-side valves on the liquid and vapor circuits between the second transfer stage and the evaporator, configured to close during the active stroke and open during the inactive stroke.

7. The machine according to claim 1, wherein the expansion device is a positive displacement device and comprises:

a cylinder;

a piston sliding in the cylinder and defining two variable volumes in the cylinder, a first of the two variable volumes being connected to the evaporator;

a discharge valve configured to connect the second of the two variable volumes to the condenser during the active stroke; and a check valve configured to connect the second variable volume to the evaporator during the inactive stroke.

8. The machine according to claim 1, comprising a valve between the expansion device and the condenser, configured to open during the active stroke and close during the inactive stroke.

* * * * *